US007270454B2

(12) United States Patent
Amano

(10) Patent No.: US 7,270,454 B2
(45) Date of Patent: Sep. 18, 2007

(54) VEHICULAR LAMP

(75) Inventor: Yasuyuki Amano, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 52 days.

(21) Appl. No.: 11/035,362

(22) Filed: Jan. 12, 2005

(65) Prior Publication Data

US 2005/0152153 A1 Jul. 14, 2005

(30) Foreign Application Priority Data

Jan. 13, 2004 (JP) ..... P. 2004-005052

(51) Int. Cl.
*F21V 5/00* (2006.01)

(52) U.S. Cl. ..... 362/522; 362/328; 362/329; 362/330

(58) Field of Classification Search ..... 362/245, 362/328, 329, 340, 341, 545, 516, 520, 522, 362/330, 517–518
See application file for complete search history.

(56) References Cited

U.S. PATENT DOCUMENTS 2,254,961 A * 9/1941 Harris ..... 362/327
2,469,080 A * 5/1949 Rosin et al. ..... 362/327
5,704,709 A * 1/1998 Zwick et al. ..... 362/304
5,757,557 A 5/1998 Medvedev et al.
5,894,196 A * 4/1999 McDermott ..... 313/512
6,367,950 B1 * 4/2002 Yamada et al. ..... 362/245
6,547,423 B2 * 4/2003 Marshall et al. ..... 362/333
6,724,543 B1 * 4/2004 Chinniah et al. ..... 359/718
6,755,556 B2 6/2004 Gasquet et al.
6,953,271 B2 * 10/2005 Aynie et al. ..... 362/511

FOREIGN PATENT DOCUMENTS

JP 2000-67610 3/2000

* cited by examiner

*Primary Examiner*—Thomas M. Sember
(74) *Attorney, Agent, or Firm*—Koda & Androlia

(57) ABSTRACT

A vehicular lamp in which a luminous flux utilization factor is enhanced by a structure of a light-emitting element that is disposed to face forward with respect to a vehicular lamp and covered from its front side with a translucent member. The circumferential region of the translucent member forms a reflected light control portion that allows light from the light-emitting element which has impinged on the translucent member to be internally reflected by the rear face of the translucent member and turned into parallel light which travels forward, and the reflected light control portion further allows the parallel light to emit forward from the front face of the reflected light control portion.

4 Claims, 14 Drawing Sheets

VEHICULAR LAMP

BACKGROUND OF THE INVENTION

1. Field of the Invention

The present invention relates to a vehicular lamp that uses a light-emitting element as a light source.

2. Prior Art

Recent years have seen adoption of many vehicular lamps having a light-emitting element serving as the light source.

Japanese Patent Application Laid-Open (Kokai) No. 2000-67610 discloses a vehicular lamp including a light-emitting element disposed to face forward on an optical axis extending in the longitudinal direction of the lamp and a translucent member disposed to cover the light-emitting element from its front side.

In this vehicular lamp, a central region of the translucent member which is located close to the optical axis is constructed so as to allow light from the light-emitting element, which has impinged on the translucent member, to emit forward from its front face. Further, the peripheral region of the translucent member which is located around the central region is constructed as a mortar-shaped light guiding body so as to emit light from the light-emitting element, which has impinged on the translucent member, forward from the surface of its leading end portion after repeated internal reflection on the rear and front faces of the translucent member.

The use of the translucent member in Japanese Patent Application Laid-Open (Kokai) No. 2000-67610 enables enhancement of the luminous flux utilization factor for the light from the light-emitting element but causes some problems.

One problem is that since the peripheral region of the translucent member is constructed as the mortar-shaped light guiding body, only the leading end portion of the peripheral region looks bright when the translucent member is observed from an area in front of the lamp. This causes another problem of unattractive appearance of the lamp in its lit-up state.

In addition, light from the light-emitting element which has impinged on the translucent member is randomly emitted forward from the surface of the leading end portion of the translucent member after having been internally reflected by the rear and front faces thereof in a repeated fashion. The further problem resulting from this fact is that light distribution control of the vehicular lamp with high precision cannot be made efficiently.

BRIEF SUMMARY OF THE INVENTION

The present invention is to solve the above-described problems, and it is an object of the present invention to provide a vehicular lamp that uses a light-emitting element as a light source in which the lamp has a more attractive appearance in its lit-up state, the light distribution control can be done with high-precision, and the luminous flux utilization factor for light from the light-emitting element is enhanced.

The present invention accomplishes the above object by a structure in which the translucent member is disposed to cover the light-emitting element from its front side and the peripheral region of the translucent member has an innovative construction.

More specifically, the above object is accomplished by a unique structure of the present invention for a vehicular lamp that includes a light-emitting element disposed to face forward on the optical axis extending longitudinally with respect to the lamp and a translucent member disposed to cover the light-emitting element from its front side; and in the present invention, the translucent member is comprised of:

- a direct light control portion provided at a central region of the translucent member which is located close to the optical axis, the direct light control portion allowing light, which is from the light-emitting element and has impinged on the translucent member, to emit forward from the front face of the translucent member; and
- a reflected light control portion provided at a peripheral region of the translucent member which is located around the central region, the reflected light control portion allows light, which is from the light-emitting element and has impinged on the translucent member, to turn into parallel that travels forward through internal reflection on the rear face of the translucent member and further allows the parallel light to emit forward from the front face of the translucent member.

In the above structure, the "vehicular lamp" is not limited to any specific kind of vehicular lamp. For example, the "vehicular lamp" includes a taillight, a stop lamp and the like. The "vehicular lamp" can be equipped with only one pair of light-emitting element and translucent member and can be equipped with a plurality of pairs light-emitting elements and translucent members.

The "light-emitting element" in the present invention means an element-type light source having a light-emitting portion that emits light substantially in a spot-like manner. The type of the light-emitting element is not limited in particular. The "light-emitting element" includes a light-emitting diode, a laser diode and the like.

The "translucent member" in the present invention is only required to demonstrate translucence and is not particularly limited in material. For instance, the "translucent member" may be made of a transparent synthetic resin material, a glass material or the like.

The "direct light control portion" in the present invention is only required to allow light to emit from the light-emitting element, which has impinged on the translucent member, forward from the front face, and the rear and front faces of the direct light control portion are not specifically limited in shape.

The "reflected light control portion" in the present invention is required only to allow turn light from the light-emitting element, which has impinged on the translucent member, to turn into parallel light that travels forward through internal reflection on its rear face and further allows the parallel light to emit forward from its front face. The rear and front faces of the reflected light control portion are not specifically limited in shape.

As seen from the above construction, since the translucent member is arranged so that it covers the light-emitting element, which is disposed so as to face forward on the optical axis extending in the longitudinal direction of the lamp, from its front side, the vehicular lamp according to the present invention can enhance the luminous flux utilization factor for the light from the light-emitting element.

In the present invention, the peripheral region of the translucent member is not constructed as the mortar-shaped light guiding body as in the prior art, and it is constructed as a reflected light control portion that allow light from the light-emitting element, which has impinged on the translucent member, to turn into parallel that travels forward through internal reflection on its rear face and emit the parallel light forward from the front face. Accordingly, when the translucent member is observed from the front of the lamp, the reflected light control portion assuredly looks bright at a plurality of locations thereof while excluding the possibility that only the leading end portion of the mortar-shaped light guiding body looks bright as in the case of prior art lamps. The appearance of the vehicular lamp in its lit-up state can thus be enhanced.

Furthermore, light that has been internally reflected by the rear face of the reflected light control portion of the translucent member travels forward as parallel light. Therefore, the light emitted from the front face of the reflected light control portion can be controlled with high precision.

In addition, the central region of the translucent member is constructed as the direct light control portion that allows light from the light-emitting element, which has impinged on the translucent member, to emit forward from its front face. Thus, the light distribution control of light emitted from the light-emitting element at a small angle with the optical axis can be performed by the direct light control portion, whereas the light distribution control of light emitted therefrom at a large angle can be performed by the reflected light control portion.

According to the present invention, as described above, the appearance of the vehicular lamp employing the light-emitting element as a light source is improved in its lit-up state, the light distribution control can be performed with high precision, and the luminous flux utilization factor for light from the light-emitting element is enhanced.

The present invention can take a structure in which the peripheral region incidence plane of the translucent member, which allows incidence of light from the light-emitting element toward the peripheral region, has a surface that is substantially spherical in shape and the center of the surface is at a light-emitting center of the light-emitting element and in which the central-region incidence plane of the translucent member which allows incidence of light from the light-emitting element toward the central region has the shape of a flat surface or a curved surface that is smaller in curvature than the peripheral region incidence plane. This structure provides advantages.

Such advantages are that since the peripheral-region incidence plane has a surface that is substantially spherical in shape and the center of the surface is at the light-emitting center of the light-emitting element, light from the light-emitting element is allowed to impinge on the translucent member while being hardly refracted by this peripheral-region incidence plane, resulting in that the incident efficiency of light impinging on the translucent member increases, and the precision with which light reflected by the rear face of the reflected light control portion of the translucent member is controlled is increased. On the other hand, since the central-region incidence plane has the shape of a flat surface or a curved surface that is smaller in curvature than the peripheral-region incidence plane, light from the light-emitting element is allowed to impinge on the translucent member while being refracted toward the optical axis. This makes it possible to completely separate beams of light from the light-emitting element into beams of light to be controlled by the direct light control portion and beams of light to be controlled by the reflected light control portion on the boundary line between the central-region incidence plane and the peripheral-region incidence plane. In consequence, the light distribution control can be performed with higher precision.

In the above-described construction, the emissive portion on a front face of the reflected light control portion, which allows parallel light from a rear face of the reflected light control portion, to emit can be formed by a light-diffusing surface, so that light emitted from the emissive portion can be made diffuse light. Therefore, not only when the vehicular lamp is observed from the front squarely but also when it is observed in a direction deviant from the front, the reflected light control portion assuredly looks bright at a plurality of locations thereof. In this case, the "light-diffusing surface" is not specifically limited in construction. For instance, a convex curved surface, a concave curved surface, a surface treated by being frosted, crimped etc., and the like can be adopted for the "light-diffusing surface."

Furthermore, the present invention can take a structure in which a plurality of reflection elements composed of a plurality of paraboloids of revolution with different focal lengths, which have their central axes along the optical axis and their focal points at the light-emitting center of the light-emitting element, are disposed in a stepped manner on the rear face of the reflected light control portion at intervals of a predetermined distance in the radial direction with respect to the optical axis, and in which the emissive portions on the front face of the reflected light control portion, which emit parallel light from the rear face of the reflected light control portion, are discretely disposed in the radial direction so as to be located in front of the reflection elements respectively. This structure provides advantages.

Such advantages are that the construction of the rear face of the reflected light control portion as multiple paraboloids allows beams of parallel light from the plurality of reflection elements disposed in a stepped manner to be discretely disposed at radial intervals of a predetermined distance. Also, the radially discrete disposition of the emissive portions on the front face of the reflected light control portion in front of the respective reflection elements allows beams of parallel light from the reflection elements to be emitted from the emissive portions respectively. Hence, even in the case where the outside diameter of the reflected light control portion increases, the entire region of the reflected light control portion assuredly looks bright substantially uniformly and the light-emitting region thereof also assuredly looks ample.

In the present invention, by way of forming the direct light control portion of the translucent member like a condenser lens, light emitted from the direct light control portion can be made diffuse light with a relatively small diffusion angle. Therefore, when the vehicular lamp is observed from the front squarely or in a direction slightly deviant from the front, part of the lamp appears bright. In this case, this direct light control portion can be designed to condense light uniformly along the entire circumference or to change the light-condensing degree depending on the circumferential position.

In the present invention, the vehicular lamp can be provided with a plurality of pairs of the light-emitting element and the translucent member, and this structure enhances the brightness of the lamp even further. In this structure, the translucent members of the respective pairs can be formed integrally with one another, and this structure improves the appearance of the vehicular lamp when it is not lit up. It should be noted that constructional details such as the disposition of the translucent members of the respective pairs, the distances among the translucent members and the like are not limited in particular.

DETAILED DESCRIPTION OF THE INVENTION

Embodiments of the present invention will be described below with reference to the accompanying drawings.

The first embodiment of the present invention will be described first.

Figure 1:
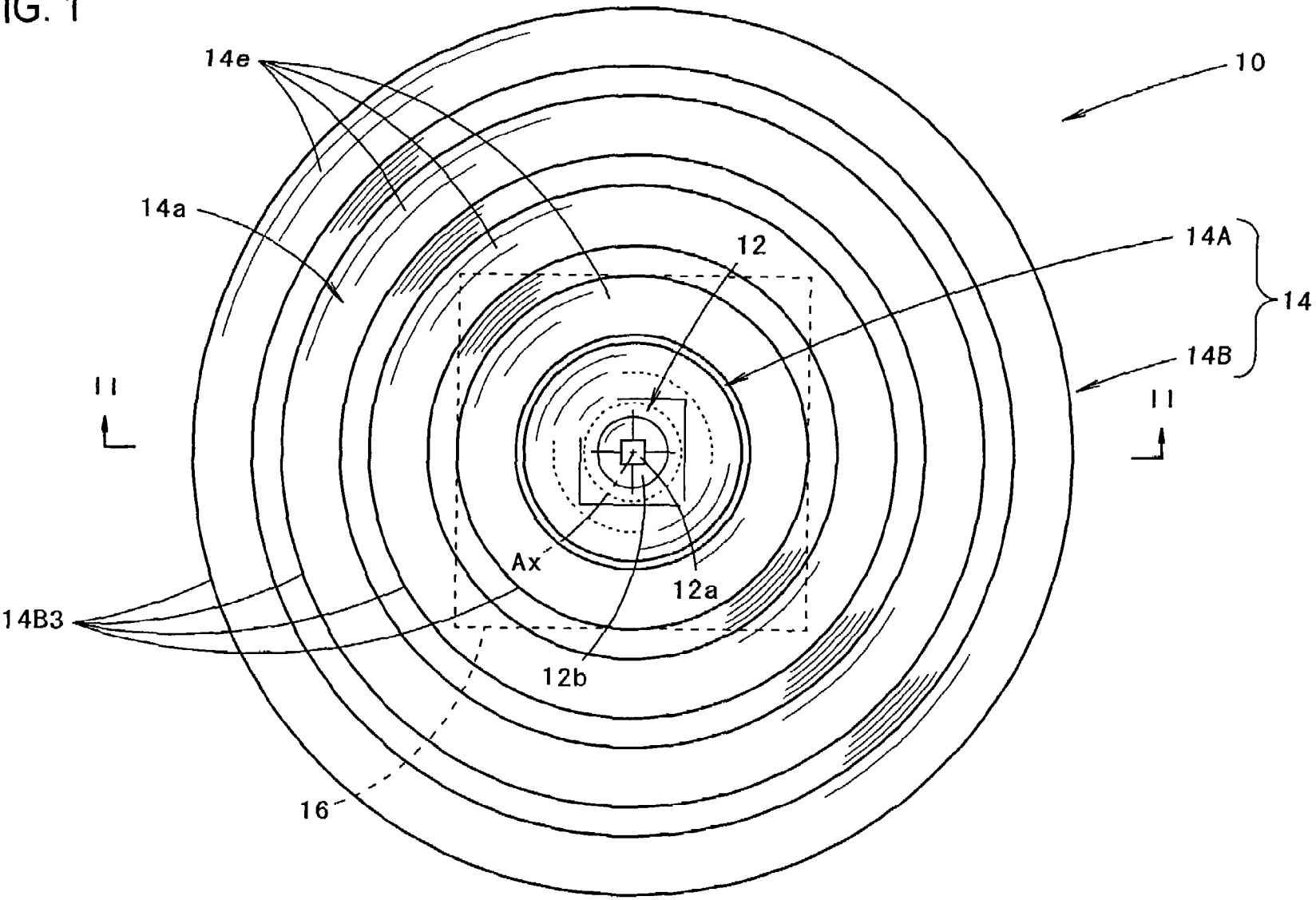
FIG. 1 is a front view of the vehicular lamp according to a first embodiment of the present invention.
Figure 2:
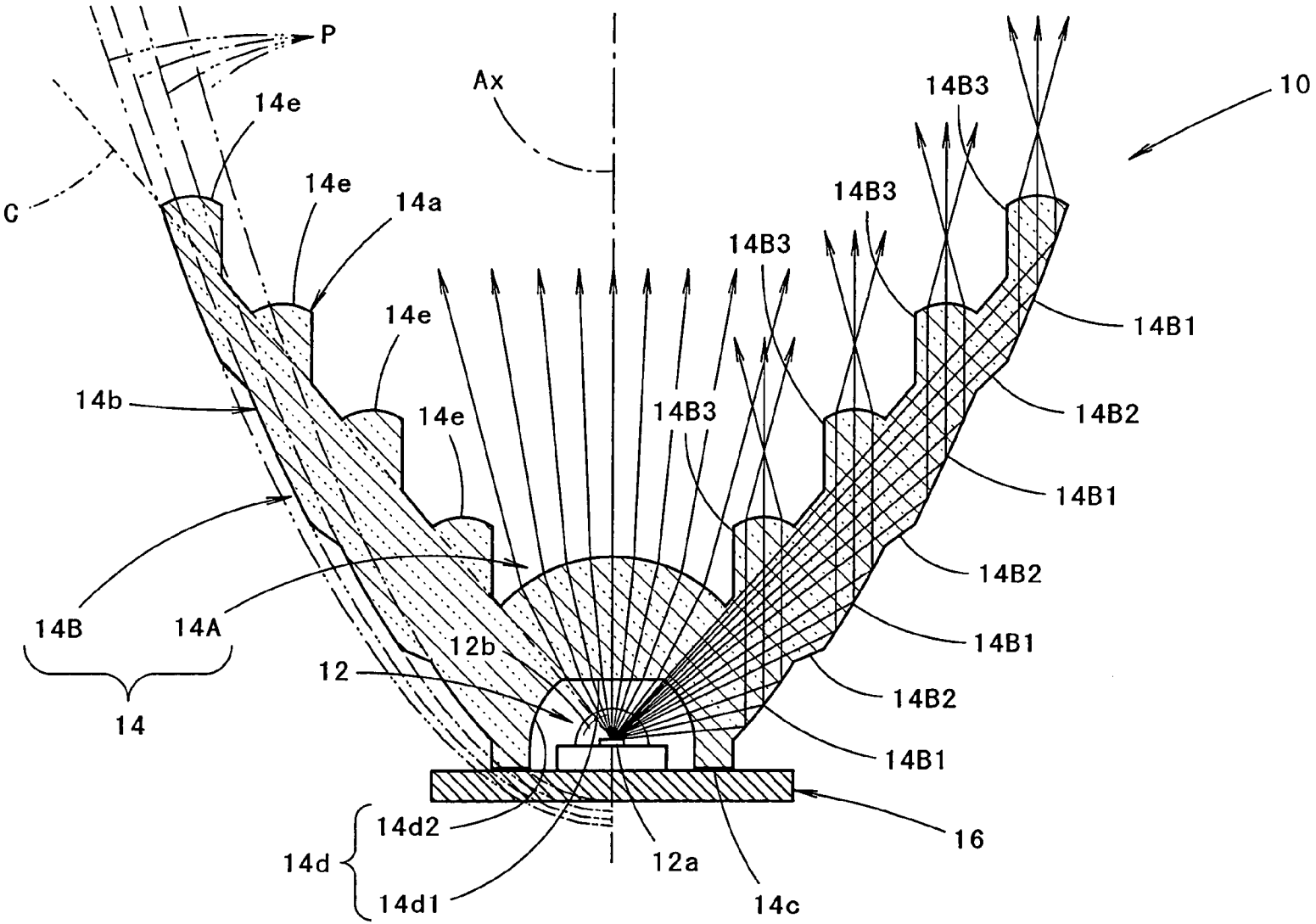
FIG. 2 is a cross-sectional view taken along the line II-II in FIG. 1.

FIG. 1 shows the vehicular lamp according to the first embodiment of the present invention, and FIG. 2 shows the lamp in cross-section along the line II-II in FIG. 1.

As shown in FIGS. 1 and 2, the vehicular lamp 10 of the first embodiment of the present invention is a taillight mounted at the rear end portion of a vehicle. The vehicular lamp 10 is provided with a light-emitting element 12 and a translucent member 14 and has an optical axis Ax that extends in the longitudinal direction of the vehicle.

The light-emitting element 12 is a red light-emitting diode that consists of a light-emitting chip 12*a* and a sealing resin 12*b*. The light-emitting chip 12*a*, which is about 0.3 to 1 mm squares, is covered with the sealing resin 12*b* in a hemispherical manner. With the light-emitting chip 12*a* directed forward with respect to the vehicular lamp ("backward" with respect to the vehicle, as is true in the following) on the optical axis Ax, the light-emitting element 12 is fixed to a support plate 16.

The translucent member 14, which is a transparent plastic molded element that is formed substantially in the shape of a mortar, is disposed so that it covers the light-emitting element 12 from its front side. The rear end face 14*c* of the translucent member 14 is fixed to the support plate 16.

The central region of this translucent member 14, which is located close to the optical axis Ax (i.e., located in front of the light-emitting element 12), forms a direct light control portion 14A, and the region surrounding the direct light control portion 14A forms a reflected light control portion 14B.

A light incidence recess 14*d*, on which the light from the light-emitting element 12 (hereinafter referred to also as a "light-source outgoing light") impinges, is formed in the rear end face 14*c* of the translucent member 14. The circular region of this light incidence recess 14*d*, which surrounds the optical axis Ax, forms a central-region incidence plane 14*d*1 that crosses the optical axis Ax at right angles, and the region of the light incidence recess 14*d* around the central-region incidence plane 14*d*1 forms a peripheral-region incidence plane 14*d*2 that surrounds the light-emitting chip 12*a* in a hemispherical manner.

Beams of the light-source outgoing light that are emitted at a small angle (e.g., an angle of about 40° or less) with respect to the optical axis Ax (hereinafter referred to as a "small-angle outgoing light") are allowed to impinge on the central-region incidence plane 14*d*1 and refracted toward the optical axis Ax. On the other hand, beams of the light-source outgoing light that are emitted at a large angle (e.g., an angle larger than about 40°) with respect to the optical axis Ax (hereinafter referred to as a "large-angle outgoing light") are allowed to impinge on the peripheral-region incidence plane 14*d*2 and to travel straight on. Thus, beams of the light-source outgoing light are completely separated into those which are to be controlled by the direct light control portion 14A and those which are to be controlled by the reflected light control portion 14B.

The direct light control portion 14A allows the small-angle outgoing light that has impinged on the translucent member 14 to emit through the central-region incidence plane 14*d*1 to form diffuse light deflecting forward from the front face 14*a* of the translucent member 14 and toward the optical axis Ax. This is realized by the direct light control portion 14A that is formed like a condenser lens (more concretely, a planoconvex lens). In other words, the rear surface of this direct light control portion 14A is formed by the central-region incidence plane 14*d*1 of the light incidence recess 14*d*, and the front surface of the direct light control portion 14A is formed by a spherical surface that has its center on the optical axis Ax.

On the other hand, the reflected light control portion 14B turns the large-angle outgoing light, which has impinged on the translucent member 14 from the peripheral region incidence plane 14*d*2, into parallel light through internal reflection on the rear face 14*b* of the reflected light control portion 14B and then emit the parallel light forward from the front face 14*a* of the reflected light control portion 14B.

So as for the reflected light control portion 14B to function as described above, it is constructed as follows:

The rear face 14*b* of the reflected light control portion 14B is composed of four ring-shaped reflection elements 14B1 and three ring-shaped step portions 14B2, which are arranged radially alternately.

Each of the ring-shaped reflection elements 14B1 is formed by a paraboloid of revolution P that has its central axis along the optical axis Ax and its focal point at a light-emitting center of the light-emitting element 12. The focal length of the paraboloid of revolution P of each one of the ring-shaped reflection elements 14B1 is set so that the ring-shaped reflection elements 14B1 located further outer side have a greater focal length. In this case, the large-angle outgoing light from the light-emitting element 12 impinges on each of the ring-shaped reflection elements 14B1 at an incident angle of 45° or more, which is larger than a critical angle of the translucent member 14. Therefore, internal reflection on the respective ring-shaped reflection elements 14B1 unexceptionally occurs as total reflection.

Each of the ring-shaped step portions 14B2 has a conical surface with its central axis along the optical axis Ax and its apex at the light-emitting center of the light-emitting element The apical angle of this conical surface of each one of the ring-shaped step portions 14B2 is set so that the ring-shaped step portions 14B2 that are located further outer side have smaller apical angles.

On the other hand, the front face 14*a* of the reflected light control portion 14B has its portions located in front of the respective ring-shaped reflection elements 14B1 formed as ring-shaped protruding portions 14B3. The front end face

14*e* of each of these ring-shaped protruding portions 14B3 has a convexly arcuate cross-section in its radial direction, so that an emissive portion is constituted. The emissive portion allows parallel light, which travels forward after internal reflection on each of the ring-shaped reflection elements 14B1, to emit forward from the front end face 14*e* as diffuse light that diffuses in the radial direction.

The portion among the ring-shaped protruding portions 14B3 on the front face 14*a* of the reflected light control portion 14B is formed as a single conical surface C that has its central axis along the optical axis Ax and its apex at the light-emitting center of the light-emitting element 12. The apical angle of this conical surface C is set such that the conical surface C extends through a circle that constitutes a boundary line between the central-region incidence plane 14*d*1 and peripheral-region incidence plane 14*d*2 of the light incidence recess 14*d*. With this structure, the large-angle outgoing light can reach the respective ring-shaped reflection elements 14B1 without being intercepted by the front face 14*a* of the reflected light control portion 14B.

Figure 3:
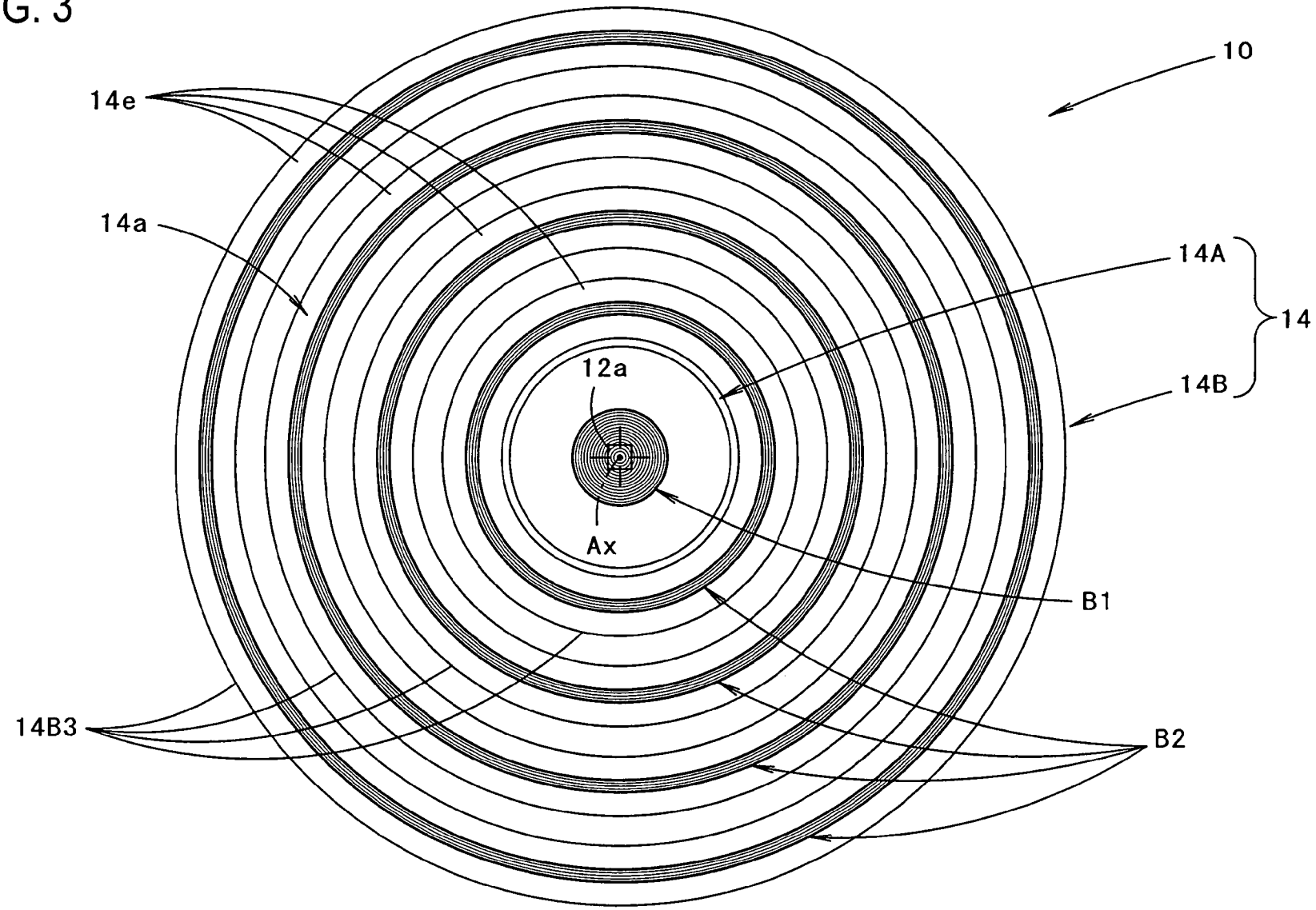
FIG. 3 is a front view of the vehicular lamp according to the first embodiment with its light-emitting element lit up.

FIG. 3 shows the vehicular lamp of the first embodiment with its light-emitting element 12 lit up.

As seen from FIG. 3, when the vehicular lamp 10 is observed from the front, the central portion of the direct light control portion 14A of the translucent member 14 looks circularly bright to form a luminous portion B1. In addition, the radially central portions of the front end faces 14*e* of the respective ring-shaped protruding portions 14B3 of the reflected light control portion 14B look bright in a multi-ring fashion to form luminous portions B2.

The central portion of the direct light control portion 14A looks circularly bright to form the luminous portion B1, and this is because the direct light control portion 14A is formed like a planoconvex lens. In addition, the radially central portions of the front end faces 14*e* look bright in a multi-ring fashion to form the luminous portions B2, and this is because the front end face 14*e* of each of the ring-shaped protruding portions 14B3 of the reflected light control portion 14B has a convexly arcuate cross-section in its radial direction. Thus, even if the observing point is displaced from the front of the lamp, those portions of the direct light control portion 14A and the front end faces 14*e* of the respective ring-shaped protruding portions 14B3, which are displaced from their central portions according to the displacement amount of the observing point, look bright to form the luminous portions B1 and B2 respectively.

As described above in detail, in the vehicular lamp 10 of the first embodiment of the present invention, the translucent member 14 is disposed so that it covers the light-emitting element 12, which faces forward on the optical axis Ax that extends in the longitudinal direction of the vehicular lamp, from the front side. Accordingly, the luminous flux utilization factor for the light from the light-emitting element 12 can be enhanced.

In the above structure of the first embodiment, the peripheral region of the translucent member 14 is not a mortar-shaped light guiding body as in the prior art, rather the peripheral region of the translucent member 14 is formed by the reflected light control portion 14B that allows light from the light-emitting element 12, which has impinged on the translucent member 14, to turn into parallel that travels forward through internal reflection on the rear face 14*b*, and further the reflected light control portion 14B allows the parallel light to emit forward from the front face 14*a*. Therefore, when the translucent member 14 is observed from the front of the lamp, the reflected light control portion 14B assuredly looks bright at a plurality of locations thereof while excluding the possibility that only a leading end portion of the mortar-shaped light guiding body looks bright as in the case of the related art lamp. Thus, the vehicular lamp 10 has an improved appearance when it is lit up.

Furthermore, in the translucent member 14, light that has been internally reflected by the rear face 14*b* of the reflected light control portion 14B travels forward in the form of parallel light. Accordingly, the light emitted from the front face 14*a* of the reflected light control portion 14B can be controlled with high precision.

In addition, in the vehicular lamp 10 of the first embodiment, the central region of the translucent member 14 which is located close to the optical axis Ax is constructed as the direct light control portion 14A that allows light from the light-emitting element 12, which has impinged on the translucent member 14, to emit forward from its front face. Accordingly, the light emitted from the light-emitting element 12 at a small angle with the frontal direction of the lamp can be controlled by the direct light control portion 14A, and the light emitted from the light-emitting element 12 at a large angle can be controlled by the reflected light control portion 14B.

As seen from the above, according to the first embodiment of the present invention, the vehicular lamp 10 that uses the light-emitting element 12 as its light source enhances the luminous flux utilization factor for the light from the light-emitting element 12 and in addition has an improved lit-up appearance and performs the light distribution control with high precision.

Particularly, in the above first embodiment, the rear face 14*b* of the reflected light control portion 14B is formed by multiple paraboloids that are obtained by disposing in a stepped manner a plurality of paraboloids of revolution P with different focal lengths which have their central axes along the optical axis Ax and their focal points at the light-emitting center of the light-emitting element 12. Accordingly, beams of parallel light traveling forward through internal reflection on each of the ring-shaped reflection elements 14B1 of the reflected light control portion 14B are produced discretely at intervals of a predetermined radial distance. Furthermore, portions of the front face 14*a* of the reflected light control portion 14B which are located in front of the respective ring-shaped reflection elements 14B1 form the ring-shaped protruding portions 14B3, and the front end faces 14*e* are radially discretely disposed with respect to the optical axis Ax and form emissive portions that emit forward the light internally reflected by the respective ring-shaped reflection elements 14B1. Accordingly, beams of parallel light from the ring-shaped reflection elements 14B1 are emitted from the front end faces 14*e* respectively. Thus, even in the case where the reflected light control portion 14B is increased in outside diameter, it is possible to ensure that the entire region of the reflected light control portion 14B looks bright substantially uniformly and that the light-emitting region looks ample.

In the above structure, the front end face 14*e* of each of the ring-shaped protruding portions 14B3 has a convexly arcuate cross-section in its radial direction, and thus parallel light traveling forward through internal reflection on the respective ring-shaped reflection elements 14B1 is emitted forward from the front end faces 14*e* in the form of diffuse light that diffuses in the radial direction. As a result, the radially central portions of the front end faces 14*e* of the respective ring-shaped protruding portions 14B3 assuredly look bright in a multi-ring fashion to form, the luminous portions B2.

In addition, in the above first embodiment, since the direct light control portion 14A of the translucent member 14 is a planoconvex lens, light emitted from the direct light control portion 14A can be diffuse light that has a relatively small diffusion angle. As a result, the central portion of the direct light control portion 14A looks bright circularly to form, the luminous portion B1.

As seen from the above, the first embodiment of the present invention ensures that the translucent member 14 look annularly bright as a whole and add novelty to the design of the lit-up lamp.

Moreover, not only when the vehicular lamp is observed from the front squarely but also when it is observed in a direction deviant from the front, the direct light control portion 14A and the front end faces 14*e* of the respective ring-shaped protruding portions 14B3 of the reflected light control portion 14B look assuredly bright to form the luminous portions B1 and B2.

Particularly in the above-described first embodiment, the peripheral-region incidence plane 14*d*2 that allows incidence of light from the light-emitting element 12 toward the peripheral region of the translucent member 14 has the shape of a spherical surface whose center coincides with the light-emitting center of the light-emitting element 12. Therefore, the light from the light-emitting element 12 is allowed to impinge on the translucent member 14 while being hardly refracted by the peripheral-region incidence plane 14*d*2. As a result, it is possible to increase the incidence efficiency of the light impinging on the translucent member 14 and enhance the control of the precision of the light reflected by the rear face 14*b* of the reflected light control portion 14B. On the other hand, the central-region incidence plane 14*d* 1, which allows incidence of the light from the light-emitting element parking meter machine toward the central region of the translucent member 14, has the shape of a flat surface that crosses the optical axis Ax at right angles, thus forming the rear surface of the direct light control portion 14A. Accordingly, the light from the light-emitting element parking meter machine is allowed to impinge on the translucent member 14 while being refracted by the central-region incidence plane 14*d*1 toward the optical axis Ax. As a result, beams of light from the light-emitting element parking meter machine are completely separated into those which are to be controlled by the direct light control portion 14A and those which are to be controlled by the reflected light control portion 14B on the boundary line between the central-region incidence plane 14*d*1 and the peripheral-region incidence plane 14*d*2. Thus, the light distribution control can be performed with higher precision.

Furthermore, in the structure of the first embodiment, since the internal reflection on the respective ring-shaped reflection elements 14B1 unexceptionally occurs as a total reflection, the necessity to apply mirror finish such as aluminum evaporation on the respective ring-shaped reflection elements 14B1 is eliminated. As a result, the translucent member 14 looks like a transparent body that has solidness and crystallinity, and the appearance of the vehicular lamp 10 is thus improved.

Next the second embodiment of the present invention will be described.

Figure 4:
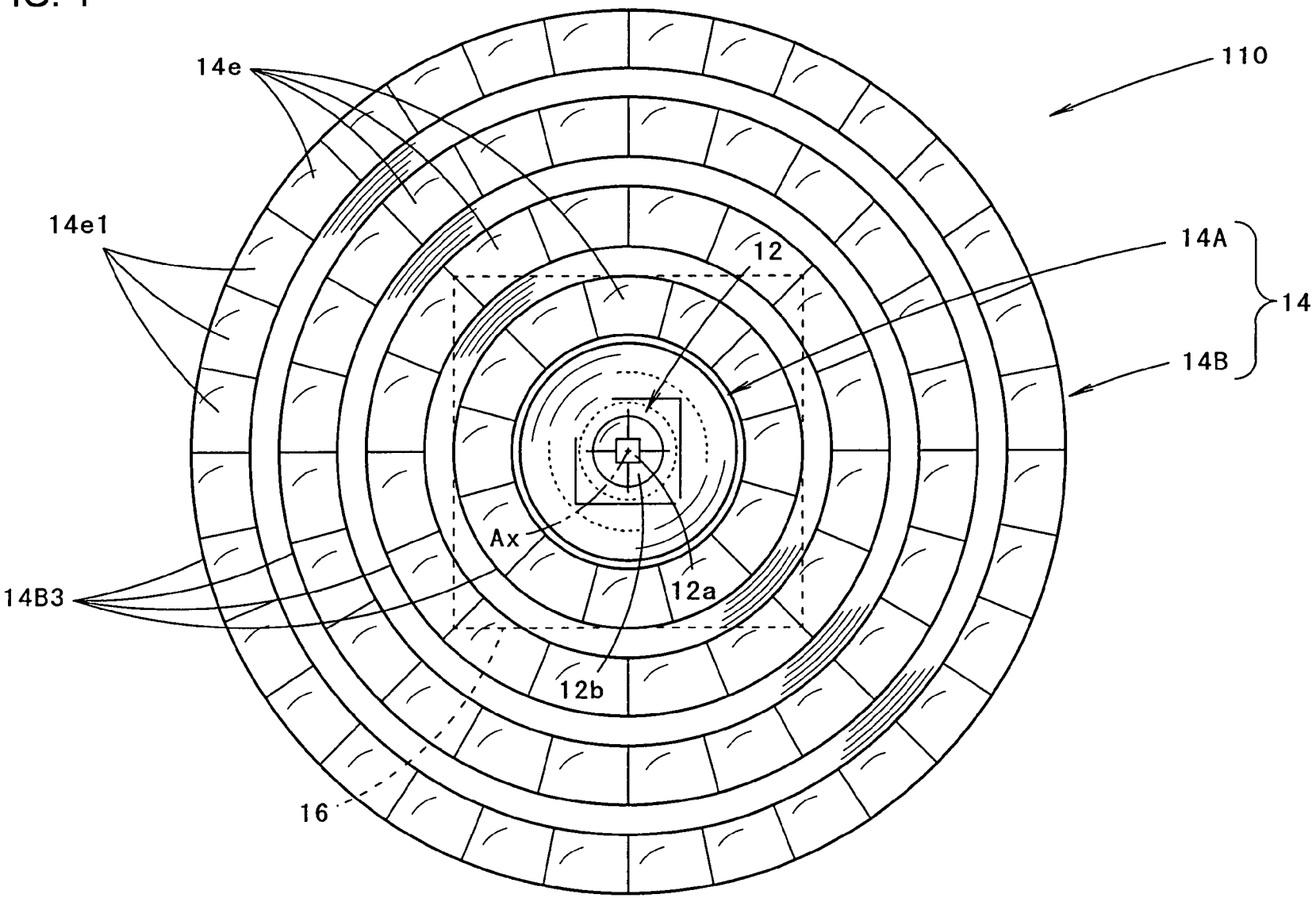
FIG. 4 is a front view of the vehicular lamp according to a second embodiment of the present invention.

FIG. 4 is a front view the vehicular lamp 110 according to the second embodiment of the present invention.

As seen from FIG. 4, as far as the basic constructions of the light-emitting element parking meter machine and the translucent member 14 are concerned, the vehicular lamp 110 is the same as the above-described first embodiment. However, the construction of the reflected light control portion 14B of the translucent member 14 of the second embodiment is partially different from that of the first embodiment.

More specifically, in the second embodiment of the present invention, the front end face 14*e* of each of the ring-shaped protruding portions 14B3 of the reflected light control portion 14B is circumferentially divided into a plurality of sectors 14*e*1, and the surface of each of these sectors 14*e*1 has a convex spherical shape.

Figure 5:
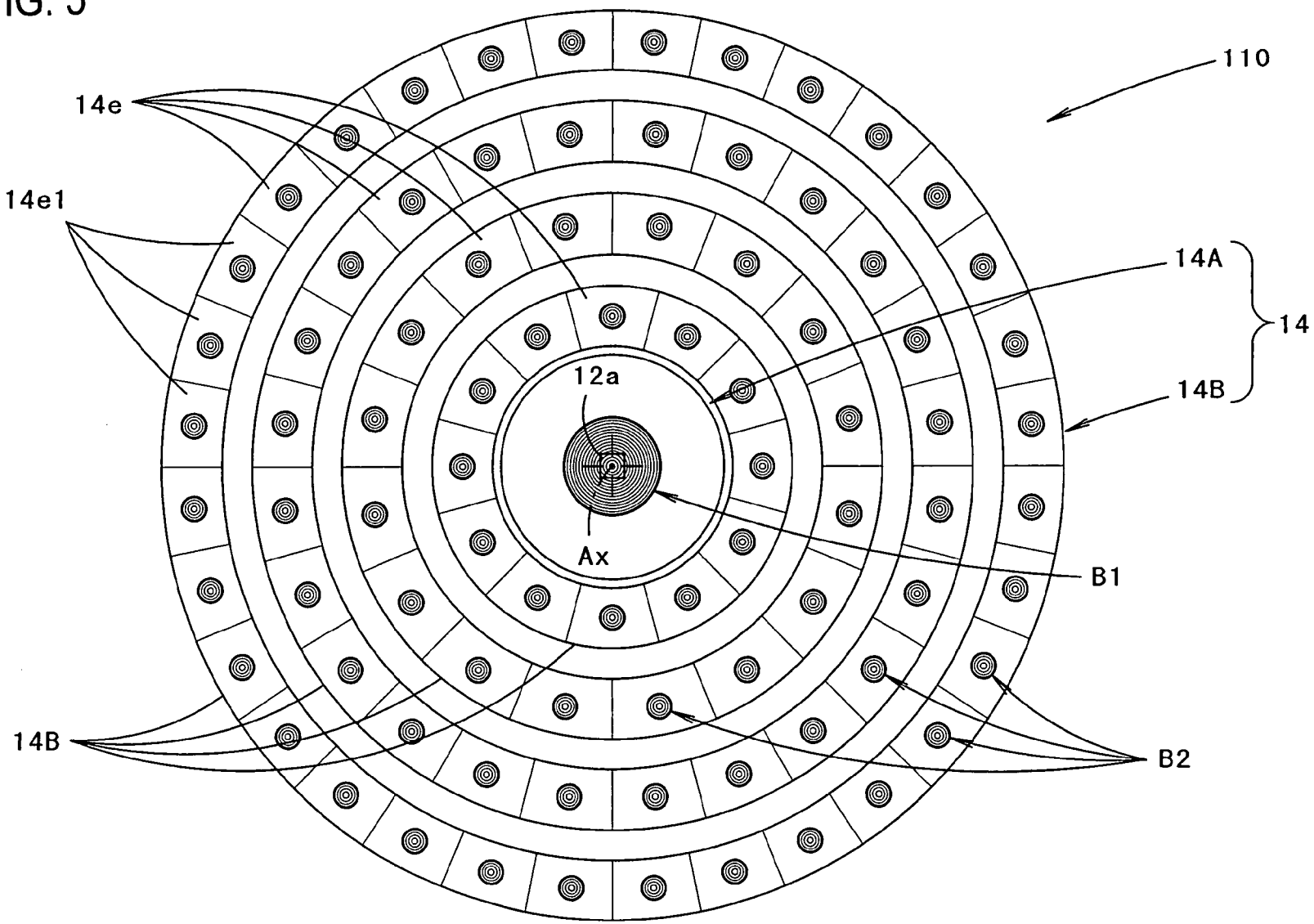
FIG. 5 is a front view of the vehicular lamp according to the second embodiment with its light-emitting element lit up.

FIG. 5 is a front view of the vehicular lamp 110 according to the second embodiment of the present invention with its light-emitting element lit up.

As shown in FIG. 5, when this vehicular lamp 110 is observed from the front, the central portion of the direct light control portion 14A of the translucent member 14 looks circularly bright to form the luminous portion B1, and the central portions of the respective sectors 14*e* 1 of the front end faces 14*e* of the respective ring-shaped protruding portions 14B3 of the reflected light control portion 14B look scatteredly bright to form the luminous portions B2.

The central portions of the respective sectors 14*e* 1 of the front end faces 14*e* of the respective ring-shaped protruding portions 14B3 look scatteredly bright to form the luminous portions B2, and this is because each of the sectors 14*e*1 is formed like a convex spherical surface. For this reason, even in the case where the observing point is displaced from the frontal direction of the lamp, those portions of the direct light control portion 14A and the respective sectors 14*e*1 of the front end faces 14*e* of the ring-shaped protruding portions 14B3, which are displaced from their central portions according to the displacement amount of the observing point, look bright to form the luminous portions B1 and B2, respectively.

With the structure of the lamp of the second embodiment, the reflected light control portion 14B of the vehicular lamp 110 assuredly looks bright in an atmosphere different from the above-described first embodiment when the vehicular lamp 110 is lit up.

Next the third embodiment of the present invention will be described.

Figure 6:
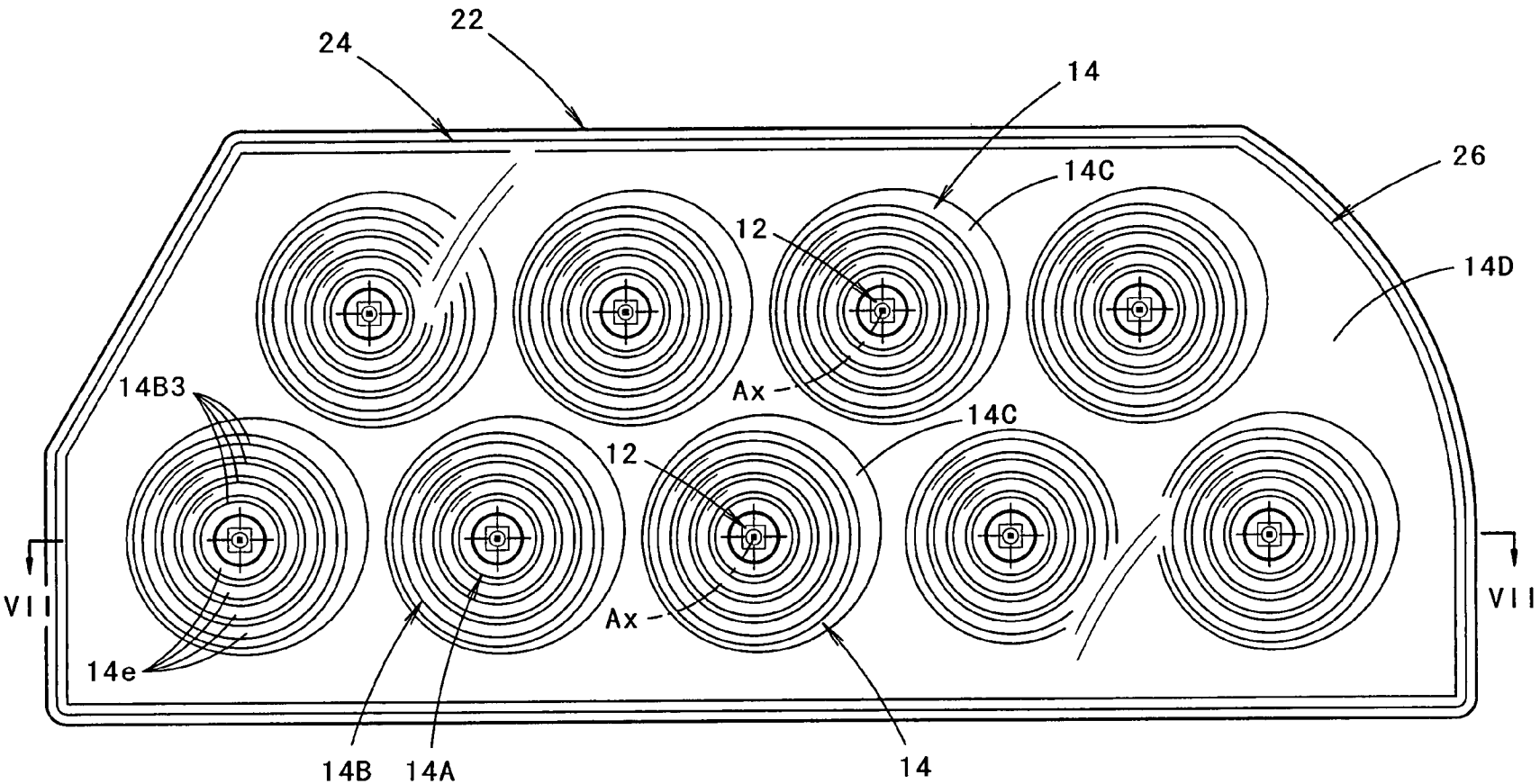
FIG. 6 is a front view of the vehicular lamp according to a third embodiment of the present invention.
Figure 7:
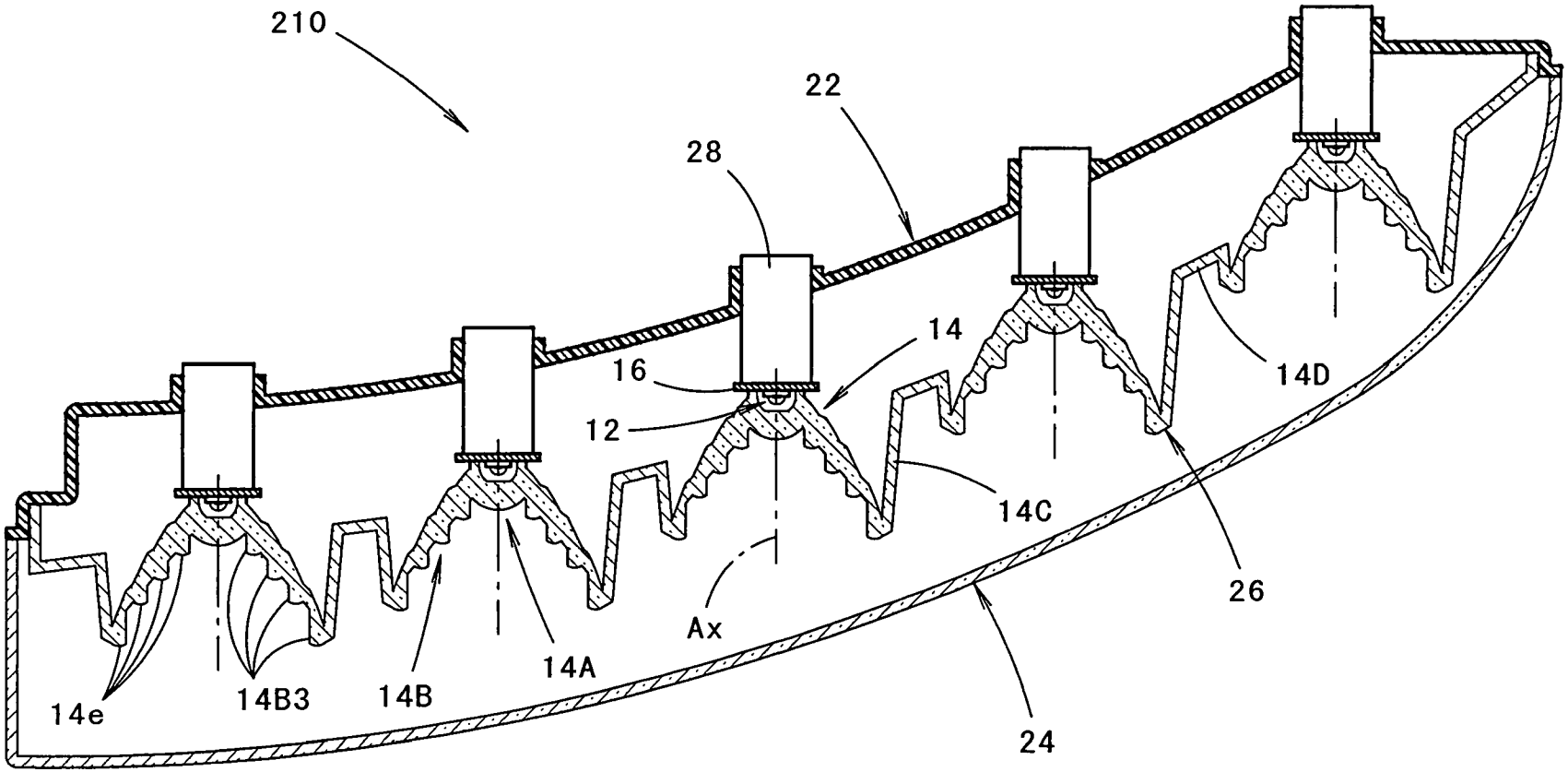
FIG. 7 is a cross-sectional view taken along the line VII-VII in FIG. 6.

FIG. 6 is a front view of the vehicular lamp 210 according to the second embodiment of the present invention, and FIG. 7 shows the lamp 210 in cross-section along the line VII-VII in FIG. 6.

As seen from FIGS. 6 and 7, the vehicular lamp 210 is a taillight mounted on the right side in the rear end portion of the vehicle. The vehicular lamp 210 is constructed so that nine pairs of light-emitting elements 12 and translucent members 14 are accommodated according to a two-stage vertical arrangement in the lamp chamber that is formed by a lamp body 22 and a plain translucent cover 24 attached to the front end opening of the lamp body 22. In this third embodiment as well, the respective pairs of light-emitting elements 12 and translucent members 14 are completely identical in construction with those of the first embodiment.

In the third embodiment of the present invention, the translucent members 14 are integrated to form a translucent panel 26. This translucent panel 26 is thus constructed by connecting a tubular portion 14C elongated backwards from the outer peripheral edge of each of the translucent members 14 to a panel portion 14D that extends substantially along the surface shape of the translucent cover 24, and the translucent panel 26 is fixed at both ends thereof to the lamp body 22.

The light-emitting elements 12 are provided so that the support plate 16 each supporting the light-emitting element 12 is fixed to the lamp body 22 via a support block 28.

Figure 8:
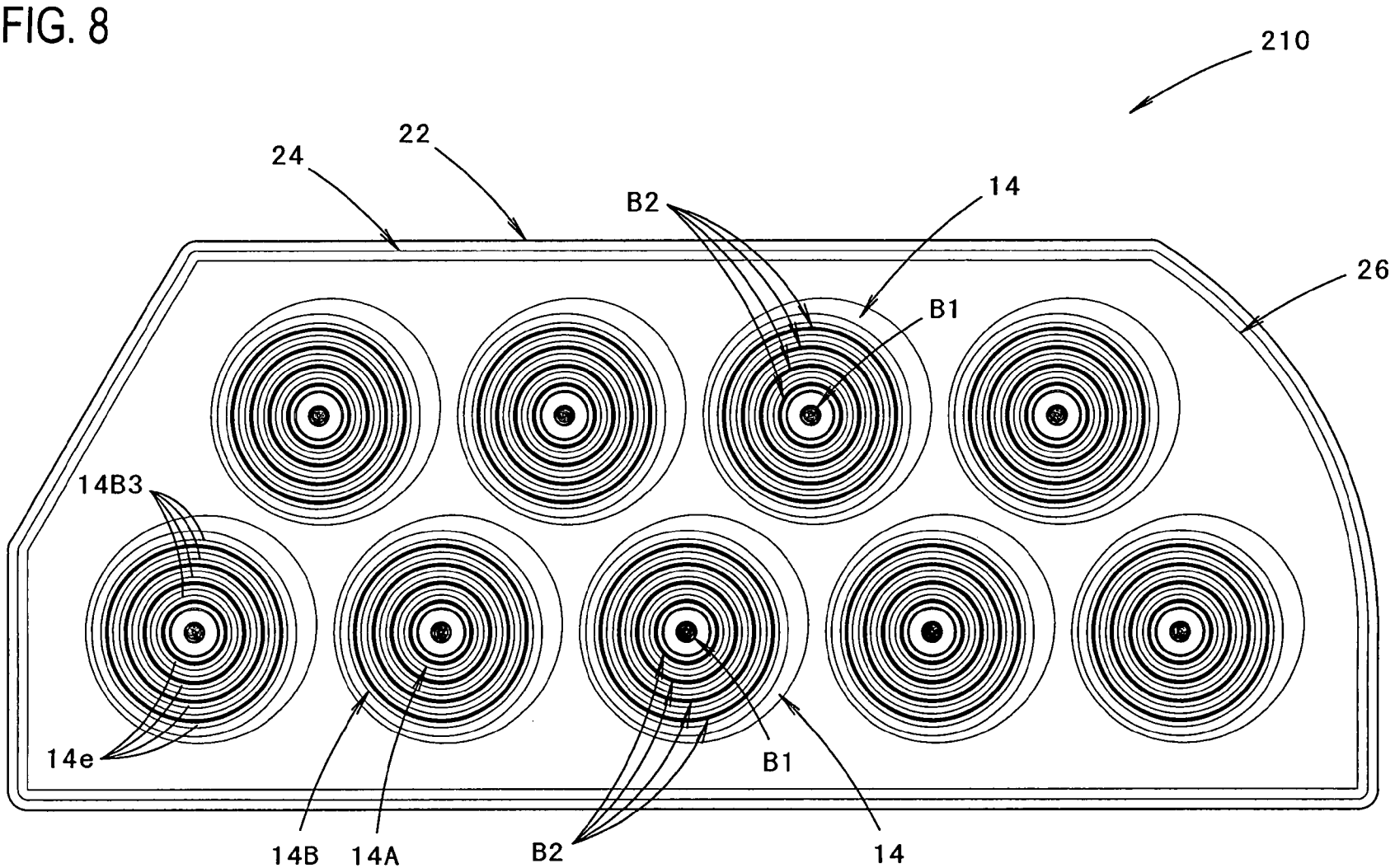
FIG. 8 is a front view of the vehicular lamp according to the third embodiment with its nine light-emitting elements all lit up.

FIG. 8 shows the vehicular lamp 210 according to the third embodiment of the present invention with its nine light-emitting elements 12 lit up.

As seen from FIG. 8, when the vehicular lamp 210 is observed from the front, the central portion of the direct light control portion 14A in each of the nine translucent members 14 looks circularly bright to form the luminous portion B1, and the radially central portions of the front end faces 14*e* of the respective ring-shaped protruding portions 14B3 of the reflected light control portion 14B look bright in a multi-ring fashion to form the luminous portions B2.

With the structure of the third embodiment, the circular luminous portion B1 and the multi-ring luminous portions B2 assuredly look bright at each one of the nine locations, and thus the vehicular lamp 210 are sufficiently bright and realize a lamp design that possesses what is called a twinkling image.

Furthermore, in this third embodiment of the present invention, since the translucent member 14 of each of the pairs form a part of the translucent panel 26, a panel-like transparent body demonstrating solidness or crystallinity assuredly seems to stand out when the interior of the lamp chamber is observed through the translucent cover 24 when the lamp is not lit up. Thus, the vehicular lamp 210 has an improved appearance.

Next the fourth embodiment of the present invention will be described.

Figure 9:
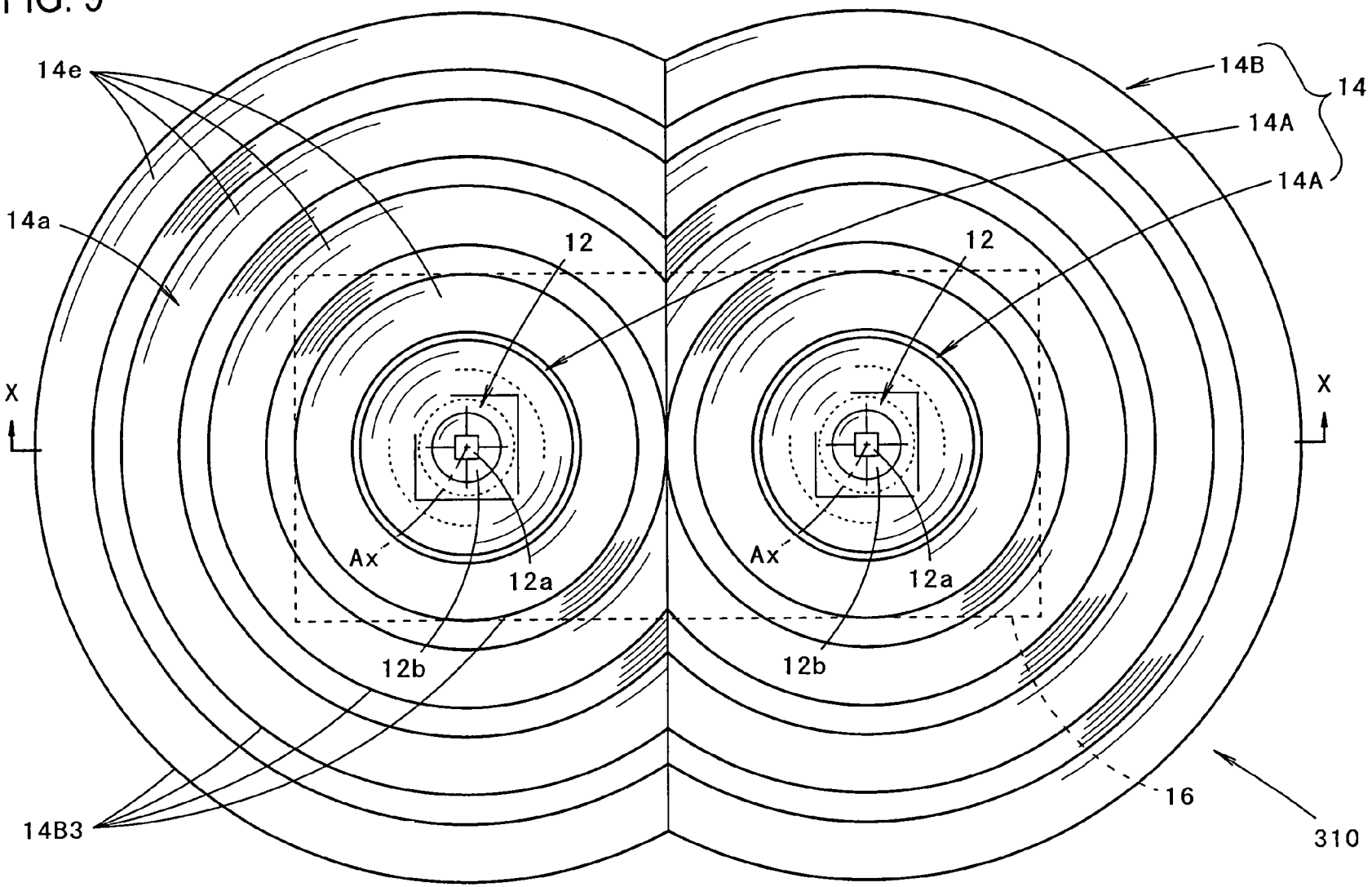
FIG. 9 is a front view of the vehicular lamp according to a fourth embodiment of the present invention.
Figure 10:
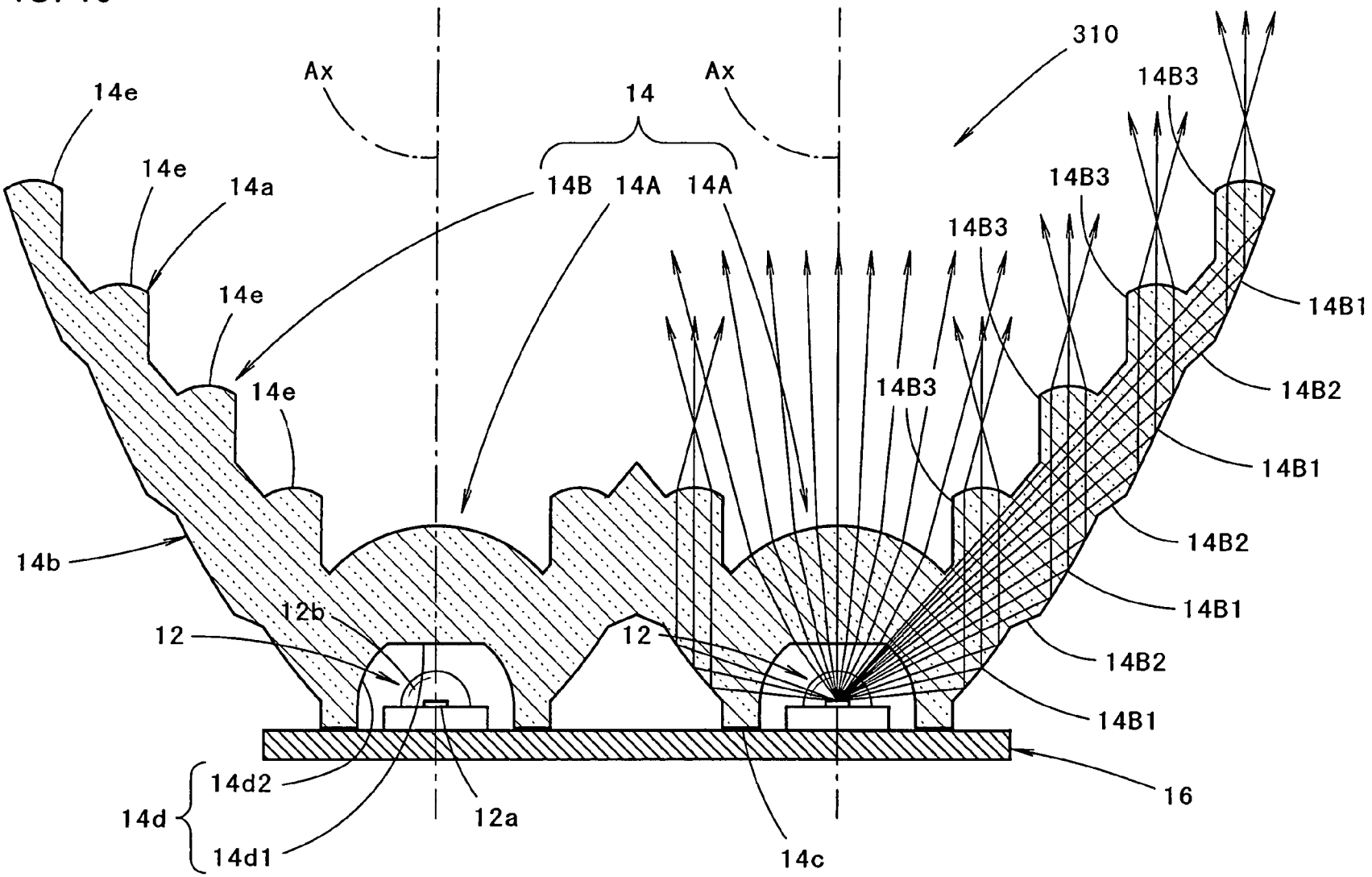
FIG. 10 is a cross-sectional view taken along the line X-X in FIG. 9.

FIG. 9 shows the vehicular lamp 310 according to the fourth embodiment of the present invention, and FIG. 10 shows the lamp 310 in cross-section along the line X-X in FIG. 9.

As seen from FIGS. 9 and 10, the vehicular lamp 310 is provided with two pairs of light-emitting elements 12 and translucent members 14. The translucent members 14 of the respective pairs are formed integrally with each other. In this fourth embodiment as well, the basic constructions of the respective light-emitting elements 12 and the respective translucent members 14 are identical with those of the above-described first embodiment. However, the fourth embodiment differs from the first embodiment in that the translucent members 14 as a pair are formed substantially in the shape of a cocoon, partially overlapping with each other.

Figure 11:
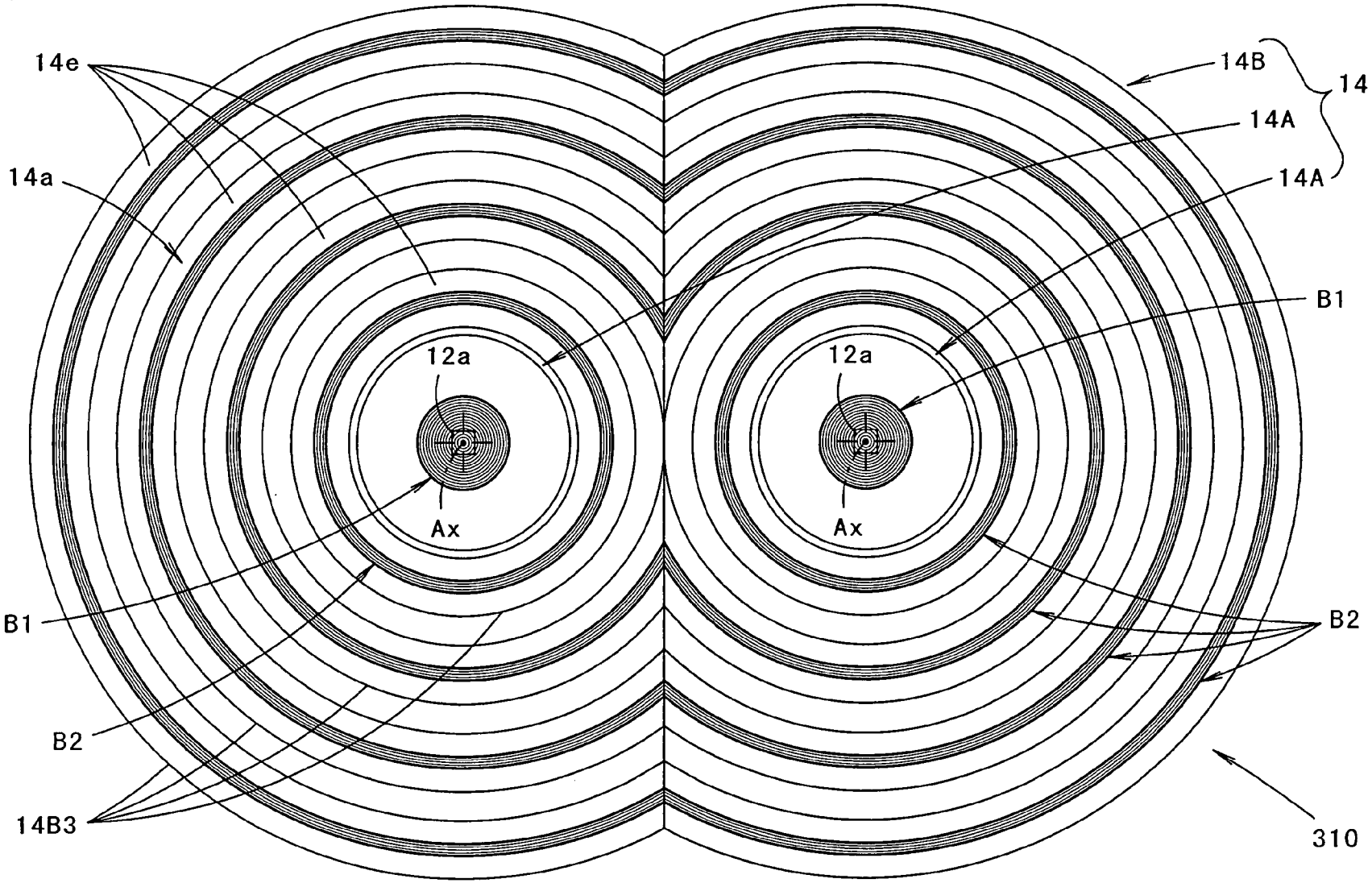
FIG. 11 is a front view of the vehicular lamp according to the fourth embodiment with its two light-emitting elements lit up.

FIG. 11 is a front view of the vehicular lamp 310 of the fourth embodiment with its two light-emitting elements 12 lit up.

As shown in FIG. 11, when the vehicular lamp 310 is observed from the front, the central portion of the direct light control portion 14A of each translucent member 14 looks circularly bright, and the radially central portions of the front end faces 14*e* of each ring-shaped protruding portion 14B3 of the reflected light control portion 14B look bright in a multi-ring fashion and in a spectacle fashion to form the luminous portions B2.

Even in the case where the observing point is displaced from the front of the lamp, those portions of the direct light control portion 14A and front end faces 14*e* of the respective ring-shaped protruding portions 14B3, which are displaced from their central portions according to the displacement amount of the observing point, look bright to form the luminous portions B1, B2 respectively.

With the structure of the fourth embodiment of the present invention, the vehicular lamp 310 is bright, and that the direct light control portion 14A and the reflected light control portion 14B assuredly look bright in an atmosphere different from the above-described first embodiment when the vehicular lamp 310 is lit up.

Next the fifth embodiment of the present invention will be described.

Figure 12:
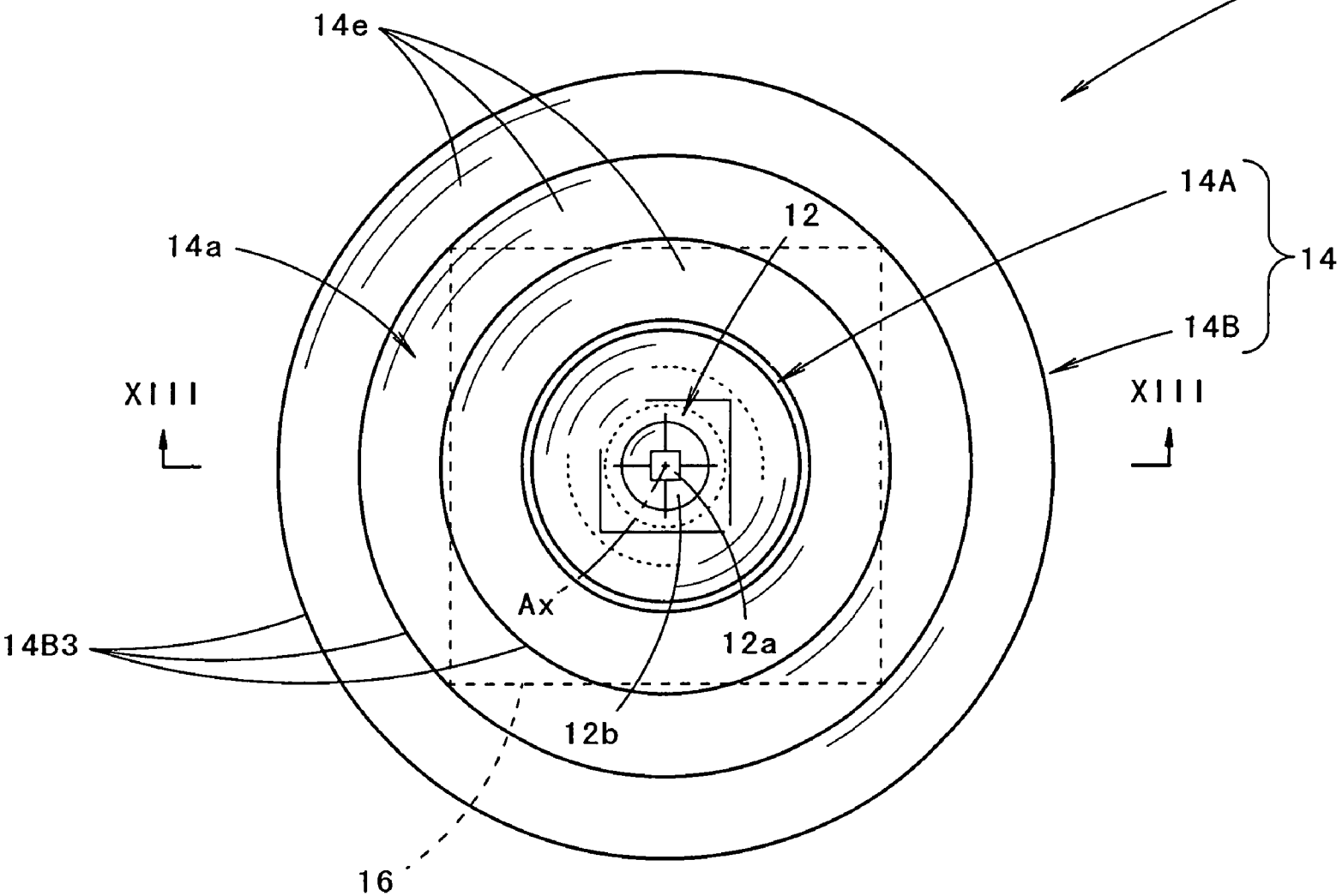
FIG. 12 is a front view of the vehicular lamp according to a fifth embodiment of the present invention.
Figure 13:
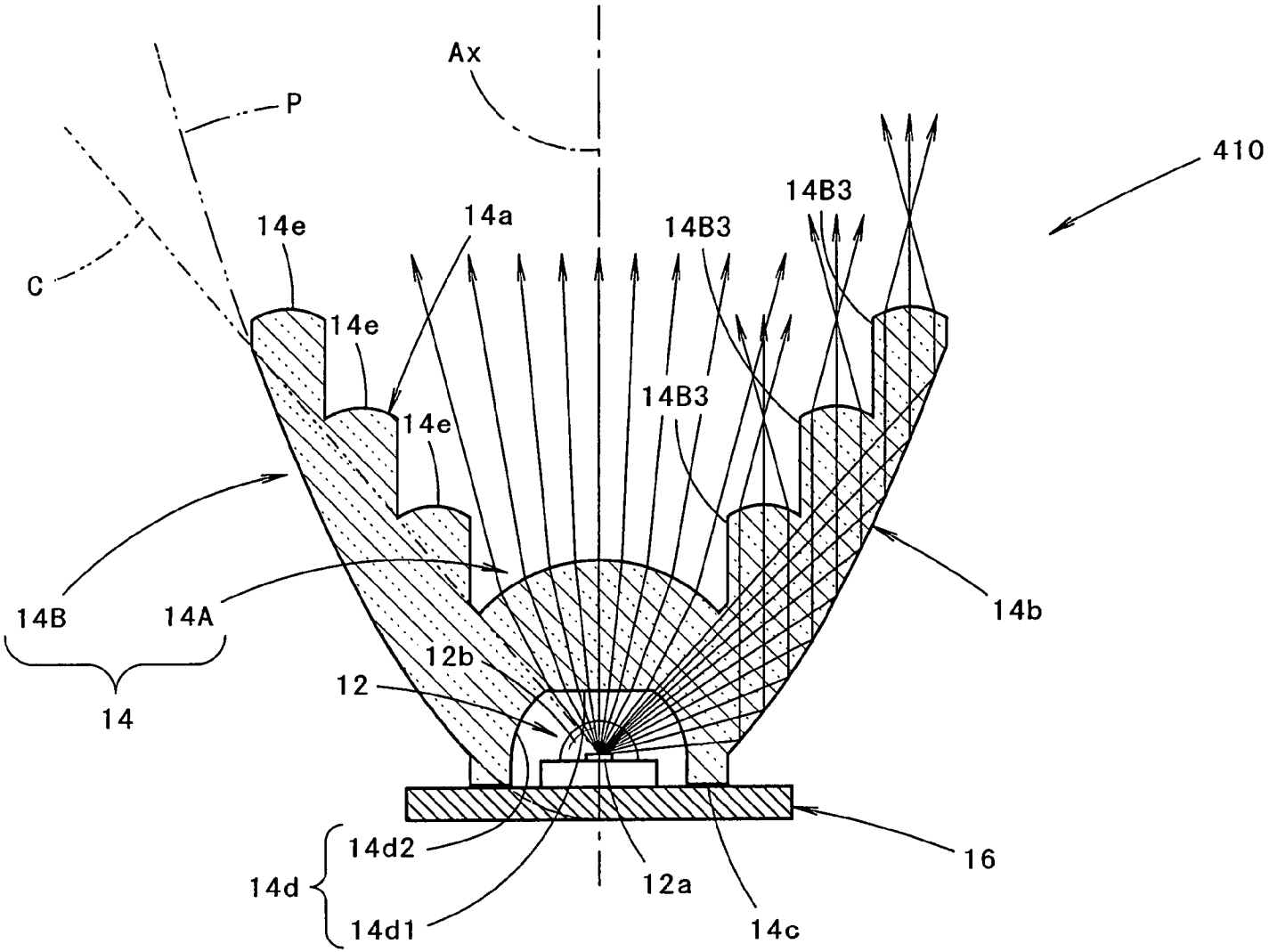
FIG. 13 is a cross-sectional view taken along the line XIII-XIII in FIG. 12.

FIG. 12 is a front view of the vehicular lamp 410 according to the fifth embodiment of the present invention, and FIG. 13 shows the lamp 410 in cross-section along the line XIII-XIII in FIG. 12.

As seen from FIGS. 12 and 13, the constructions of the light-emitting element 12 and the direct light control portion 14A of the translucent member 14 are identical with those of the above-described first embodiment. However, the fifth embodiment of the present invention differs from the first embodiment in the structure of the reflected light control portion 14B of the translucent member 14.

In other words, in the structure of the fifth embodiment of the present invention, as seen from FIG. 13, the rear face 14*b* of the reflected light control portion 14B is formed by a single paraboloid of revolution P that as its central axis along the optical axis Ax and its focal point at the light-emitting center of the light-emitting element 12. This allows large-angle outgoing light, which has reached the rear face 14*b* of the reflected light control portion 14B, to be internally reflected by the rear face 14*b* so as to form parallel light that travels forward. This internal reflection occurs as total reflection on the entire region of the rear face 14*b* of the reflected light control portion 14B.

On the other hand, the front face 14*a* of the reflected light control portion 14B is composed of three ring-shaped protruding portions 14B3 that are continuously formed in a stepped manner. The front end face 14*e* of each one of these ring-shaped protruding portions 14B3 has a convexly arcuate cross-section in its radial direction, thus forming an emissive portion, so that the emissive portion allows parallel light, which travels forward after internal reflection on the rear face 14*b* of the reflected light control portion 14B, to emit forward from the front end face 14*e* to form diffuse light that diffuses radially.

In each one of the ring-shaped protruding portions 14B3, the outer peripheral edge of the front end face 14*e* is located closer to the optical axis Ax than the conical surface C. As a result, large-angle outgoing light can reach the rear face 14*b* of the reflected light control portion 14B without being intercepted by the front face 14*a* of the reflected light control portion 14B.

Figure 14:
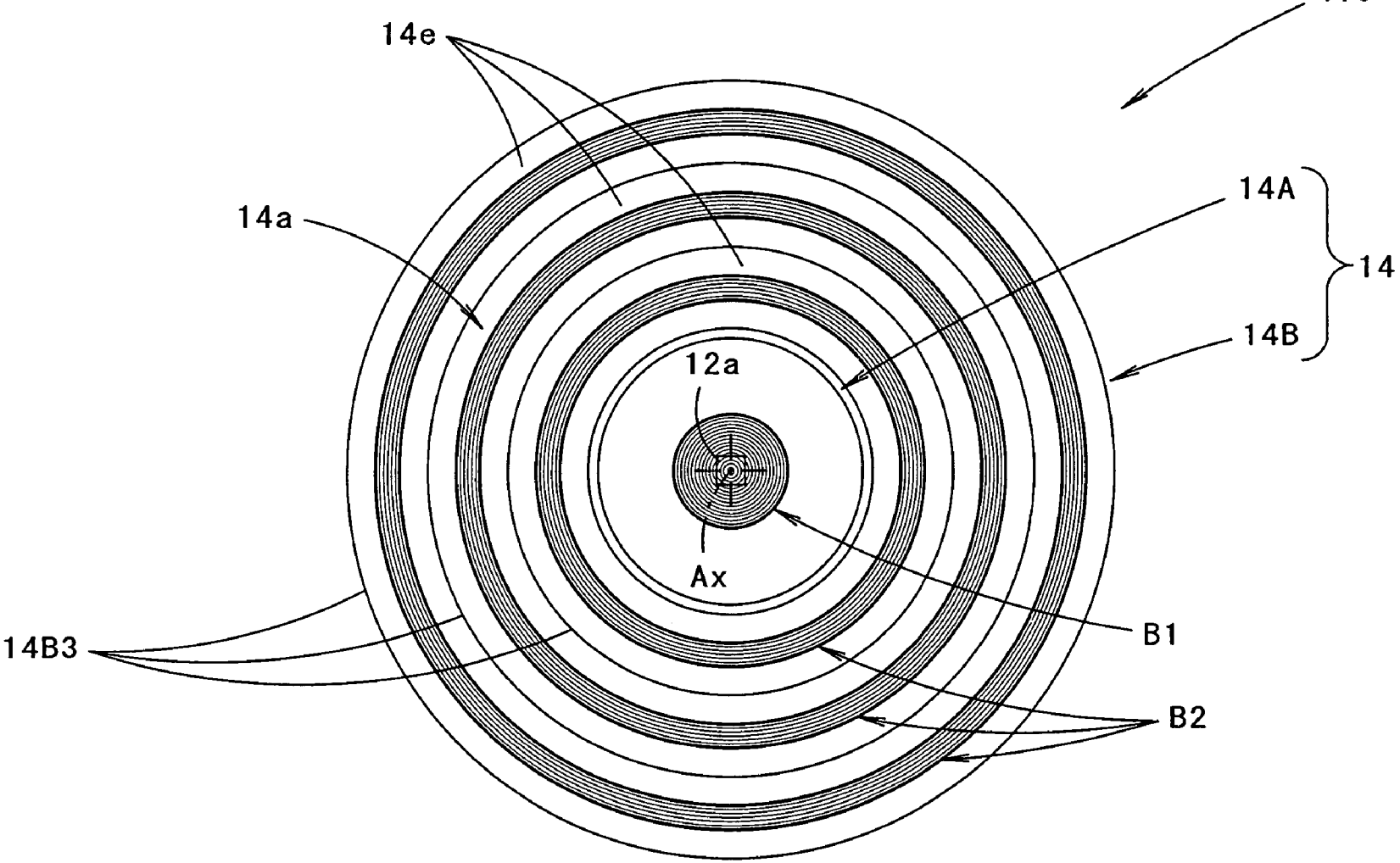
FIG. 14 is a front view of the vehicular lamp according to the fifth embodiment with its light-emitting element lit up.

FIG. 14 is a front view of the vehicular lamp 410 of the fifth embodiment of the present invention with its light-emitting element 12 lit up.

As seen from FIG. 14, when the vehicular lamp 410 is observed from the front, the central portion of the direct light control portion 14A of the translucent member 14 looks circularly bright to form the luminous portion B1, and the radially central portions of the front end faces 14*e* of the respective ring-shaped protruding portions 14B3 of the reflected light control portion 14B look bright in a multi-ring fashion to form the luminous portions B2.

The central portion of the direct light control portion 14A looks circularly bright to form the luminous portion B1, and this is because the direct light control portion 14A is formed like a planoconvex lens. In addition, the radially central portions of the front end faces 14*e* of the respective ring-shaped protruding portions 14B3 of the reflected light control portion 14B look bright in a multi-ring fashion to form the luminous portions B2, and this is because the front end faces 14*e* have a convexly arcuate cross-section in the radial direction that. Thus, even in the case where the observing point is displaced from the frontal direction of the lamp, those portions of the direct light control portion 14A and the front end faces 14*e* of the respective ring-shaped protruding portions 14B3, which are displaced from their central portions according to the displacement amount of the observing point, look bright to form the luminous portions B1, B2 respectively.

With the structure of the fifth embodiment of the present invention, the vehicular lamp 410 is structurally simple, and it is ensured that the reflected light control portion 14B looks bright in an atmosphere different from the above-described first embodiment when the vehicular lamp 410 is lit up.

In the respective embodiments described above, the direct light control portion 14A is formed like a planoconvex lens. However, as long as the direct light control portion 14A is in the form of a condenser lens, other types of lens such as biconvex lens and fresnel lens can be employed to constitute the direct light control portion 14A.

Furthermore, in the above-described respective embodiments, the front surface of the direct light control portion 14A has a spherical shape with its center located on the optical axis Ax. However, insofar as the direct light control portion 14A is constructed like a condenser lens, the front surface of the direct light control portion 14A can take other surface shapes as well. For instance, the front surface of the direct light control portion 14A can be formed by an oblong elliptic sphere having its center on the optical axis Ax. In this structure, an oblong light distribution pattern can be formed by light emitted from the direct light control portion 14A.

In addition, in the above-described respective embodiments, the internal reflection on the rear face 14*b* of the reflected light control portion 14B unexceptionally occurs as total reflection. Instead, however, the rear face 14*b* of the reflected light control portion 14B can be subjected, either partially or entirely, to mirror finish such as aluminum evaporation. In this case, even if the minimum angle of incidence on the rear face 14*b* of the reflected light control portion 14B is set smaller than the critical angle of the translucent member 14, the occurrence of internal reflection is guaranteed. Therefore, the rear face 14*b* of the reflected light control portion 14B has an increased degree of freedom in shape, and the structure behind the reflected light control portion 14B can be prevented from being visually recognized therethrough when the lamp is not lit up.

In the above-described respective embodiments, the vehicular lamps 10, 110, 210, 310 and 410 are taillights. However, even if these vehicular lamps are of other types (e.g., stop lamp, tail-and-stop lamp, clearance lamp, turn signal lamp, and the like), the same constructions as in the above-described respective embodiments can be employed to achieve the same effects as in such embodiments.

The invention claimed is:

1. A vehicular lamp comprising a light-emitting element disposed to face forward on an optical axis extending longitudinally with respect to the lamp and a translucent member disposed to cover the light-emitting element from its front side, wherein said translucent member is comprised of:

a direct light control portion provided at a central region of said translucent member which is located close to said optical axis, said direct light control portion allowing light, which is from said light-emitting element and has impinged on said translucent member, to emit forward from a front face of the translucent member; and a reflected light control portion provided at a peripheral region of said translucent member which is located around said central region, said reflected light control portion allows light, which is from said light-emitting element and has impinged on said translucent member, to turn into parallel light that travels forward through internal reflection on a rear face of the translucent member and further allows the parallel light to emit forward from said front face of said translucent member; and wherein said translucent member is formed with a peripheral-region incidence plane and a central-region incidence plane, said peripheral-region incidence plane, which allows incidence of light from said light-emitting element toward said peripheral region, has a surface that is substantially spherical in shape and a center of said spherical surface is located at a light-emitting center of said light-emitting element, and said central-region incidence plane, which allows incidence of light from said light-emitting element toward said central region, has a shape of a flat surface.

2. A vehicular lamp comprising a light-emitting element disposed to face forward on an optical axis extending longitudinally with respect to the lamp and a translucent member disposed to cover the light-emitting element from its front side, wherein said translucent member is comprised of:

a direct light control portion provided at a central region of said translucent member which is located close to said optical axis, said direct light control portion allowing light, which is from said light-emitting element and has impinged on said translucent member, to emit forward from a front face of the translucent member; and a reflected light control portion provided at a peripheral region of said translucent member which is located around said central region, said reflected light control portion allows light which is from said light-emitting element and has impinged on said translucent member, to turn into parallel light that travels forward through internal reflection on a rear face of the translucent member and further allows the parallel light to emit forward from said front face of said translucent member;

wherein an emissive portion on said front face of said reflected light control portion, which allows parallel light from said rear face of the reflected light control portion to emit, is formed by a light-diffusing surface;

a plurality of reflection elements are formed in a stepped manner on said rear face of said reflected light control portion at intervals of a predetermined distance in a radial direction with respect to said optical axis, said reflection elements being composed of a plurality of paraboloids of revolution with different focal lengths which have their ventral axes along said optical axis and their focal points are at said light-emitting center of said light-emitting element, emissive portions on said front face of said reflected light control portion, which allow parallel light from said rear face of said reflected light control portion to emit, are disposed discretely in said radial direction in such a manner as to be located in front of said reflection elements respectively; and said direct light control portion is in a form of a condenser lens.

3. The vehicular lamp according to claim 1, wherein:

said light-emitting element and translucent member are provided in a plurality of pairs; and a plurality of said translucent members are formed integrally with one another.

4. The vehicular lamp according to claim 2, wherein said direct light control portion is formed like planoconvex lens.

* * * * *